US005426707A

United States Patent [19]

Wijnker

[11] Patent Number: 5,426,707

[45] Date of Patent: Jun. 20, 1995

[54] ELECTRODYNAMIC LOUDSPEAKER WITH COOLING ARRANGEMENT

[75] Inventor: Eddy L. L. Wijnker, Hoorn, Netherlands

[73] Assignee: Lainé B. V., Netherlands

[21] Appl. No.: 43,519

[22] Filed: Apr. 6, 1993

[30] Foreign Application Priority Data

Oct. 9, 1990 [NL] Netherlands ..... 90.02190

[51] Int. Cl.[6] ..... H04R 25/00

[52] U.S. Cl. ..... 381/194; 381/196; 381/203; 381/165

[58] Field of Search ..... 381/194, 199, 201, 165, 381/159, 192, 196, 203, 202, 190, ; 181/199

[56] References Cited

U.S. PATENT DOCUMENTS

| | | | |
|---|---|---|---|
| 4,539,442 | 9/1985 | Puls et al. . | |
| 4,757,547 | 7/1988 | Danley . | |
| 4,811,403 | 3/1989 | Henricksen et al. | 381/159 |
| 5,040,221 | 8/1991 | Edwards et al. | 381/194 |
| 5,091,028 | 2/1992 | Yamazaki et al. | 381/194 |

FOREIGN PATENT DOCUMENTS

| | | | |
|---|---|---|---|
| 0112559 | 7/1984 | European Pat. Off. . | |
| 0200257 | 11/1986 | European Pat. Off. . | |
| 0341926 | 11/1989 | European Pat. Off. . | |
| 869648 | 2/1942 | France . | |
| 872356 | 3/1953 | Germany . | |
| 59-138199 | 8/1984 | Japan . | |
| 0195796 | 8/1990 | Japan | 381/159 |
| 1591182 | 6/1981 | United Kingdom . | |
| 2194707 | 3/1988 | United Kingdom . | |

OTHER PUBLICATIONS

English language abstract of Japanese application 59-138 199, Japanese Abstracts, vol. 8, No. 268 (E-238) [1705], 12/07/84.

*Primary Examiner*—Curtis Kuntz
*Assistant Examiner*—Huyen D. Le
*Attorney, Agent, or Firm*—Willian Brinks Hofer Gilson & Lione

[57] ABSTRACT

A loudspeaker, comprising a magnet unit which generates a magnetic field and a movable element suspended for resilient movement around a stable rest position for radiating sound with selected properties. The loudspeaker further comprises an electrical conductor connected to the movable element and having current feed terminals. The conductor is placed in the magnetic field such that when current is passed through the conductor a force is exerted on the movable element so that the movable element is displaced from its rest position. The loudspeaker includes a cooling element producing a gas flow for forced cooling of the conductor.

14 Claims, 3 Drawing Sheets

ELECTRODYNAMIC LOUDSPEAKER WITH COOLING ARRANGEMENT

BACKGROUND OF THE INVENTION

This is a continuation of PCT/NL91/00161 filed on Aug. 30, 1991.

1. Field of the Invention

The invention relates to known loudspeakers of the type comprising a magnet unit which generates a magnetic field and an element suspended for resilient movement round a stable rest position, such as a diaphragm, a cone, a dome or other element suitable for radiating sound with selected properties. The known loudspeaker further comprises an electrical conductor, for instance a speech coil, connected to the movable element and having current feed terminals, wherein the conductor is placed in the magnetic field such that when current is passed through the conductor a force is exerted on the movable element which imparts to the element a deviation from its rest position.

2. Description of the Related Art

Reference is made for instance to the published Netherlands patent application 85.01166. Described herein is a ribbon speaker comprising a diaphragm which is clamped in a frame and in the central region of which is situated a zone containing the conductor arranged in a selected pattern.

A loudspeaker of this type is capable of radiating a certain minimal frequency sound that satisfies high quality requirements in respect of uniformity and little distortion. A drawback to such a loudspeaker however is that it suffers from power compression. This is the undesired phenomenon occurring when, due to current passing through the conductor, the conductor is subject to a considerable temperature increase which is attended by an increase in its resistance. When the voltage on the current feed terminals remains the same, the generated acoustic power decreases with such an increased resistance. Compression thus occurs.

A further drawback of the known loudspeaker is that it is capable to only a very limited extent, through natural convection, conduction and radiation, of draining the heat from the conductor. This phenomenon in combination with the relatively small output has the consequence that the loudspeaker can only generate a limited acoustic power. Loading with an impedance converter such as a horn can considerably enlarge the generated sound pressure in a limited space angle, but this does not essentially resolve the described limitation.

While the mentioned drawbacks and limitations are described with reference to a loudspeaker of the isophasic type, they also occur in other electrodynamic loudspeakers, for example a loudspeaker of the type with a magnet unit with cylindrical air gap in which a speech coil is axially movable, which speech coil drives a diaphragm or cone. In multi-channel systems such a loudspeaker is normally used for the low tones.

SUMMARY OF THE INVENTION

The above-mentioned object and other objects of the invention are achieved with a loudspeaker comprising cooling means for forced cooling of the conductor with a gas flow. Simple and inexpensive is the embodiment in which the gas flow consists of ambient air.

With a loudspeaker of the type having a diaphragm which is clamped in a frame and in the central region of which is situated a zone containing the conductor arranged in a selected pattern, the loudspeaker can have the feature that the cooling means aim a plane, directed gas flow onto the central region from at least one side. This gas flow brushes past the conductor, breaks up the thermal boundary layer thereof and thus effectively carries away the heat present therein.

This loudspeaker can have the special feature that the selected pattern has a free longitudinal central region and that the cooling means aim from both sides a plane, directed gas flow transversely of the central region, which gas flows brush past the conductors and due to mutual collision leave the diaphragm substantially in transverse direction relative to that diaphragm. The conductor will in particular be disposed in an elongate, spiral pattern leaving free the longitudinal central region. Situated on one side are the current feed terminals which are disposed in the region of the frame onto which the diaphragm is clamped.

The current feed terminals are generally coupled to terminals of the total loudspeaker system by means of a solder connection. Such terminals may have a slightly enlarged local resistance, a contact resistance, which imparts a local temperature increase when current is passed. As a consequence of a large number of such thermal cycles the contact resistance can gradually become greater, which increasingly worsens the connection. To considerably lessen this phenomenon, use can be made of a variant in which the cooling means guide a gas flow along the current feed terminals.

In a particular embodiment, the loudspeaker according to the invention has the feature that a frame is situated at some distance from the central region of the diaphragm which, together with that diaphragm, bounds gas intake slits. This frame can for instance be formed by the front wall of the cabinet, in which case the central region of the diaphragm radiates sound directly to the environment without the interposing of an impedance converter such as a horn or the like.

The mentioned ribbon loudspeaker can have the feature that the central region of the diaphragm is loaded with an impedance converter such as a horn and that the cooling means display gas intake slits bounded on one side by plates forming a continuation of the inner walls of the impedance converter and on the other side by wall portions standing at least more or less in the same position which for instance form part of the magnet unit.

In preference the heavy magnet unit, which bears the diaphragm, and the frame are mechanically separated from one another. In this respect the invention provides a loudspeaker of this type characterized by a framework, for instance in the form of a cabinet, which supports the frame and also separately supports the magnet unit with the diaphragm fixed thereto such that a space serving as gas intake slit remains free therebetween.

This loudspeaker can particularly be embodied such that the framework is a cabinet in which fan means are incorporated which can draw in ambient air and generate it via the gas intake slit exclusively through the space enclosed by the cabinet.

A loudspeaker of the stated type having a magnet unit with cylindrical air gap in which a speech coil is axially movable can display the feature that the magnet unit has at least one passage opening for passage of the gas flow and guiding thereof along the speech coil.

A loudspeaker of the type according to the invention can generally also have the characteristic that the cooling means are equipped to cool the magnet unit with a gas flow.

This is particularly advantageous in the case of a loudspeaker whereof the magnet unit comprises a permanent magnet consisting of neodymium. The per se known use of neodymium as material for the permanent magnet has the drawback that the strength of the magnetic field in the air gap is greatly dependent on the temperature of the permanent magnet. Certainly in the case of prolonged heavy load the magnetic field in the air gap can decrease due to the increased temperature such that the loudspeaker thereby becomes considerably less sensitive. The cooling of the magnet prevents this undesired phenomenon.

The cooling of the electrical driving conductor according to the invention not only has the advantage of being able to resolve and eliminate the described problems and limitations but also allows a higher electrical loading of the loudspeaker, which contributes to a higher acoustic power for radiating. Should it be the wish to realize a determined sound pressure level in a room, a smaller number of loudspeaker units will then suffice using the loudspeaker according to the invention. This can save space as well as being economically attractive to users.

Exemplary embodiments of the invention will be described in further detail below in conjunction with the drawings.

DESCRIPTION OF THE EMBODIMENTS

Figure 1:
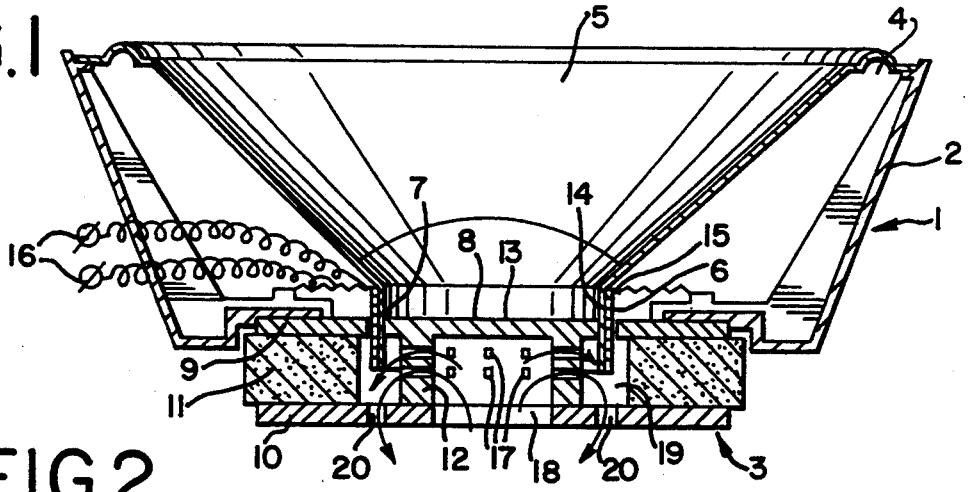
FIG. 1 shows a cross section through a cone loudspeaker according to the invention in a first embodiment.

FIG. 1 shows a loudspeaker 1 of the electrodynamic type comprising a framework 2, a magnet unit 3 coupled thereto, a cone 5 connected to the framework via a flexible suspension rim 4 and a cylindrical speech coil 6. The speech coil 6 is axially movable in an annular air gap 7 in which a strong magnetic field prevails. The air gap is bounded on the inner side by a central pole piece 8 and an annular pole piece 9 extending therearound at a distance. A magnetic closing plate 10 is situated on the underside of the central pole piece 8. Arranged between this closing plate 10 and the annular pole piece 9 is an annular permanent magnet 11.

As can be seen in FIG. 1, the central pole piece 8 comprises a cylindrical central portion 12 and a top plate 13 of greater diameter. The annular pole piece 9 has a smaller inner diameter than the permanent magnet 11. This configuration ensures a strong and concentrated magnetic field in the air gap 7.

The speech coil 7 is of known type and comprises a tube 14 serving as a speech coil carrier and a conductor 15 wound thereon in coil-like manner.

It will be apparent that when current is sent through the conductor 15 via current feed terminals 16 the speech coil 6 will be displaced counter to the resilience of the flexible suspension rim 4 through interaction with the magnetic field.

According to the invention the loudspeaker 1 is provided with cooling means for cooling the conductor 15. For this purpose the cylindrical central portion 12 of the central pole piece 8 is provided with annular rows of perforations 17 in the wall, wherein the opening 18 present on the bottom serves for supplying gas, for instance air, under pressure, wherein the gas can enter the cylindrical space 19 through the openings 17 and cool the conductor 15 and can subsequently leave the space 19 again via openings 20.

Also achieved with this configuration and also the configurations according to FIGS. 2 and 3 to be described hereinafter is that the permanent magnet 11 is cooled. This has the particular advantage that when neodymium is used as magnet material the field strength in the air gap is maintained even in the case of prolonged high electrical load of the loudspeaker 1.

Figure 2:
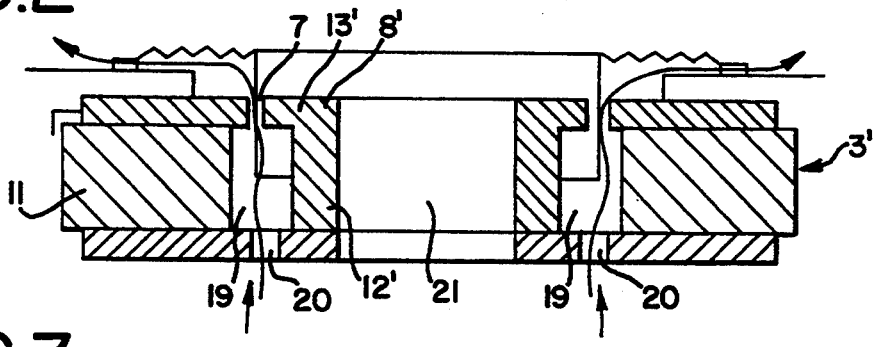
FIG. 2 is a view corresponding with FIG. 1 of a detail of a second embodiment.
Figure 3:
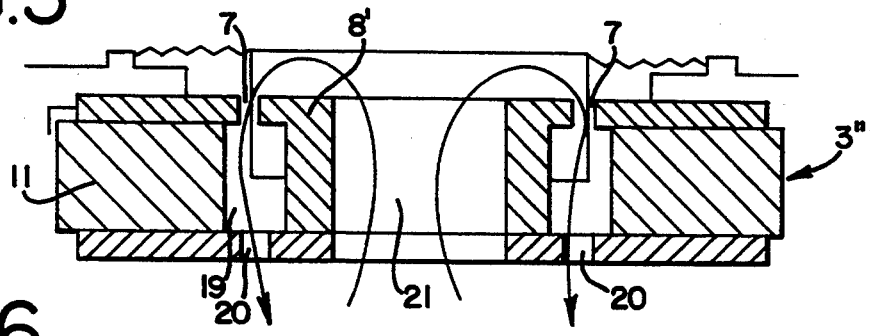
FIG. 3 is a view corresponding with FIG. 2 of a third embodiment.

FIG. 2 shows a second embodiment of the present invention. Air enters here via the openings 20, passes through the space 19 and leaves the magnet unit 3' via the air gap 7, which ensures an effective cooling of the conductor 15. The central pole piece according to FIG. 2 differs from that of FIG. 1 and is therefore designated 8'. The associated cylindrical central portion 12' has no perforations. The top plate 13' is an annular widening at the top.

The third embodiment according to FIG. 3 differs from FIG. 2 in that the through-hole 21 of the central pole piece 8' is used here for supplying air from below which enters the air gap 7 from the top, brushes along the conductor 15, thus cooling it, and once again leaves the magnet unit 3" via the space 19 and the holes 20.

It will otherwise be apparent that combinations of the mentioned embodiment details are also possible. The air flows are also designated in the figures only very generally and for purposes of orientation.

Figure 4:
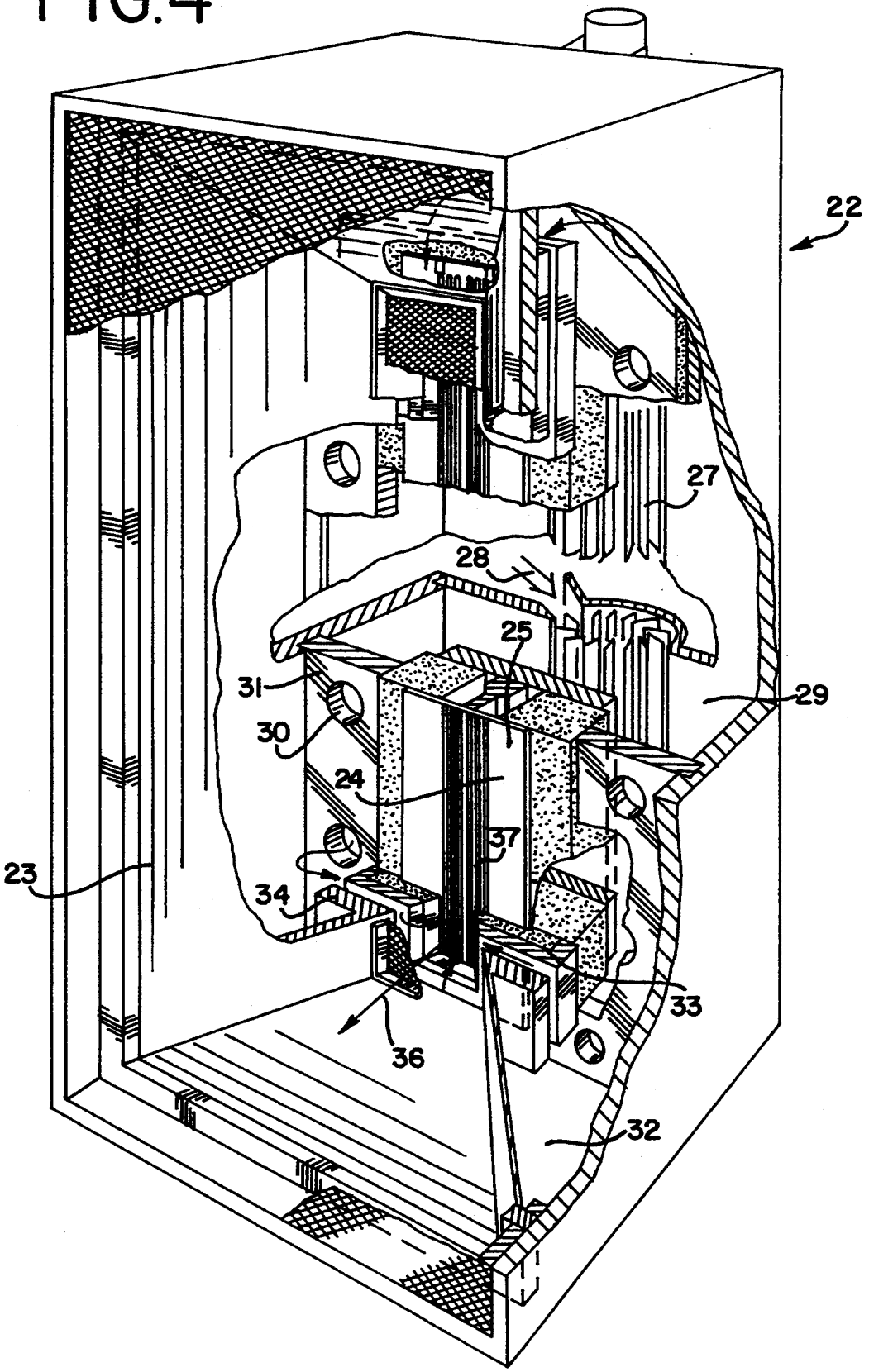
FIG. 4 is a partly broken away perspective view of a ribbon loudspeaker with horn loading accommodated in a cabinet.

FIG. 4 shows a loudspeaker cabinet 22 in which is situated a ribbon loudspeaker to be briefly described hereinbelow. This ribbon loudspeaker is of per se known type and is described for instance in the Netherlands patent application 85.01166.

The cabinet bears a horn 23 which debouches on the front side and in the throat of which is situated a diaphragm 24. This diaphragm is clamped into a frame 25 incorporated in the magnet unit 26 to be further described with reference to FIG. 6.

The cabinet bears at its rear a fan 27 which draws in ambient air 28 and blows it into the rear space 29 of cabinet 22. This air is blown via perforations 30 in a partition 31 into the forward space 32 of the cabinet 22. Available between the front plate 33 of the magnet unit 26 and the rear plate 34 of the horn 23 is a free gap through which the air can escape into the forward space.

The magnet unit 26 is fixed to the partition 31 while the horn 23 is fixed on the side of the mouth to the cabinet 22, thus on the front thereof.

Figure 6:
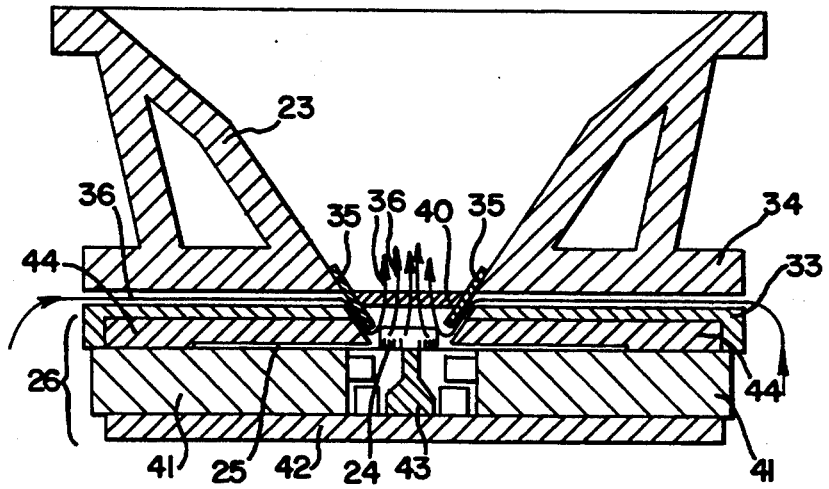
FIG. 6 shows the cross section V—V of the loudspeaker unit with loading horn of FIG. 5.
Figure 5:
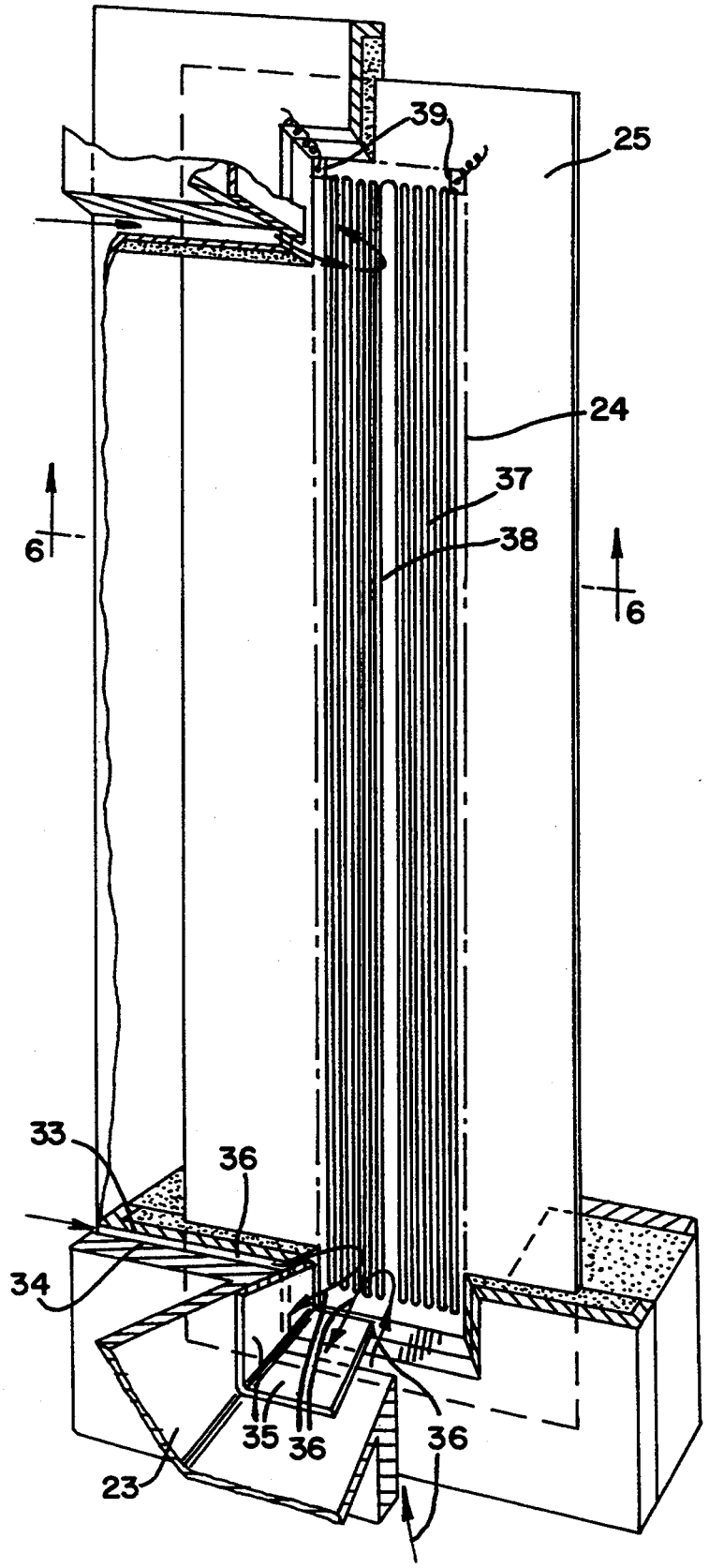
FIG. 5 shows a detail of the loudspeaker of FIG. 4.

As shown clearly in FIGS. 5 and 6 particularly, the horn has plates 35 on the side of the throat, therefore in the region of the diaphragm 24, which plates form an extension of the inner walls of horn 23. These plates 35 extend over the outflow openings of the air gaps 36, i.e. the mentioned free spaces between the magnet unit 26 and the horn 23. Thus achieved in the manner shown in FIGS. 4, 5 and 6 is that the diaphragm 24 is cooled from the long sides of both sides by the air flows brushing past which are designated with 36. Situated in the central zone of the diaphragm 24 is a spiral-like conductor 37 which has a free central region 38 as a result of its spiral shape. An effective cooling of the conductor takes place due to the air flows moving in opposing directions from the sides, and these air flows leave the diaphragm in transverse direction thereof through the horn 23.

The short sides of the diaphragm are also subjected to such an air cooling, which is of particular importance for the current feed terminals 39 shown in FIG. 5.

The diaphragm 24 is covered by a substantially acoustically transparent plate 40 arranged at some distance therefrom in the horn. This plate can consist of mesh or foamed material or the like.

For the sake of completeness, the magnet unit 26 will also be discussed briefly with specific reference to FIG. 6. This comprises two elongate permanent magnets 41 consisting of neodymium. Situated at the bottom is a magnetic closing plate 42 which carries a central pole piece 43. At the top each of the permanent magnets 41 carries a pole piece 44 having a tapering form similar to the horn 23. Due to the placing of the diaphragm 24 as shown in FIG. 6 and in particular the conductor 37 arranged thereon is achieved that this conductor co-acts as well as possible with the magnetic field between the pole piece 43 and the pole pieces 44.

Attention is also generally drawn to the fact that only the magnetically active elements may possess ferromagnetic properties. Other components situated in the vicinity of the magnet unit 3, 26 are manufactured for obvious reasons from magnetically non-active material. Use can for instance be made for the horn of a strong plastic, wood or other suitable materials. Aluminum can also be considered a suitable constructional material.

The cooling of the diaphragm in the embodiment according to the FIGS. 4, 5 and 6 can for instance also take place by blowing in air through the horn. Such a solution could have the drawback that the acoustic properties of the loudspeaker are adversely affected herewith, but this is not the case in the embodiment shown. In addition, conductors 15, 37 may be covered by a corrosion and oxidation resistant coating to prevent their corrosion and oxidation by entry of the gases stimulating corrosion or oxidation of the conductors, particularly oxygen. The coating may consist of a heat resistant material, such as a plastic, a thermoplastic or polyetherimide.

The cooling principle according to the invention is not limited to loudspeakers of the described type. Compression drivers, i.e. loudspeakers which make use of a compression space in order to increase output, can also be provided with cooling means of the type according to the invention. This relates to cooling of the conductor as well as cooling of the magnet system.

In addition to the case where neodymium is used as magnet material, cooling of the magnet system can also be worthwhile in the case of other materials.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

I claim:

1. A loudspeaker, comprising:

a magnet unit which generates a magnetic field;

a diaphragm suspended for resilient movement around a stable rest position for radiating sound with selected properties;

an electrical conductor connected to said diaphragm and having current feed terminals, wherein said conductor is placed in said magnetic field such that when current is passed through said conductor a force is exerted on said diaphragm so that said diaphragm is displaced from said rest position;

said diaphragm being attached in a frame, said diaphragm having a central region containing said conductor arranged in a selected planar pattern having a longitudinal central region lacking said conductor;

a cooling element producing a gas flow for forced cooling of said conductor, wherein said cooling element aims a planar gas flow transversely of said longitudinal central region to flow across said electrical conductor and to leave said diaphragm substantially in a perpendicular direction relative to said diaphragm.

2. The loudspeaker of claim 1, wherein said gas flow comprises ambient air.

3. The loudspeaker of claim 1, wherein said cooling element guides said gas flow along said current feed terminals.

4. The loudspeaker of claim 1, comprising:

a frame spaced from said central region of said diaphragm; and a gas intake slit positioned between said frame and said diaphragm.

5. The loudspeaker of claim 4, wherein said diaphragm comprises an impedance converter with inner walls; and said gas intake slit is bounded on one side by a plate forming a continuation of the inner walls of the impedance converter and said gas intake slit is bounded on another side by a wall portion.

6. The loudspeaker of claim 4, comprising:

a framework supporting said frame and said magnet unit, wherein said gas intake slit is defined by a space defined between said diaphragm and said magnet unit attached thereto.

7. The loudspeaker of claim 6, wherein said framework is a cabinet, said cabinet comprising:.

a fan which draws in ambient air via said gas intake slit and blow said ambient air out via said gas intake slit only through the space enclosed by said cabinet.

8. The loudspeaker of claim 1, wherein said cooling element cools said magnet unit with said gas flow.

9. The loudspeaker of claim 8, wherein said magnet unit comprises neodymium.

10. The loudspeaker of claim 1, wherein said electrical conductor is coated by a corrosion and oxidation resistant coating.

11. The loudspeaker of claim 10, wherein said coating comprises a heat resistant material.

12. The loudspeaker of claim 11, wherein said heat resistant material comprises a plastic.

13. The loudspeaker of claim 12, wherein said heat resistant material comprises a thermoplastic material.

14. The loudspeaker of claim 13, wherein said heat resistant material comprises polyetherimide.

* * * * *

UNITED STATES PATENT AND TRADEMARK OFFICE

CERTIFICATE OF CORRECTION

PATENT NO. : 5,426,707
DATED : June 20, 1995
INVENTOR(S) : Eddy L. L. Wijnker

It is certified that error appears in the above-indentified patent and that said Letters Patent is hereby corrected as shown below:

In the Claims

Column 6,

In claim 7, line 4, delete "blow" and substitute --blows--.

Signed and Sealed this

Eighteenth Day of June, 1996

Bruce Lehman

*Attest:*

BRUCE LEHMAN

*Attesting Officer*

*Commissioner of Patents and Trademarks*